US005399865A

United States Patent [19]

Umemura et al.

[11] Patent Number: 5,399,865

[45] Date of Patent: Mar. 21, 1995

[54] LIQUID METAL ION SOURCE WITH HIGH TEMPERATURE CLEANING APPARATUS FOR CLEANING THE EMITTER AND RESERVOIR

[75] Inventors: Kaoru Umemura, Kokubunji; Tohru Ishitani, Sayama, both of Japan

[73] Assignee: Hitachi, Ltd., Tokyo, Japan

[21] Appl. No.: 76,854

[22] Filed: Jun. 15, 1993

[30] Foreign Application Priority Data

Jun. 18, 1992 [JP] Japan ..... 4-159270

[51] Int. Cl.[6] ..... H01J 27/26

[52] U.S. Cl. ..... 250/423 F; 250/423 R

[58] Field of Search ..... 250/423 A, 423 F

[56] References Cited

FOREIGN PATENT DOCUMENTS

| | | | |
|---|---|---|---|
| 58-3579 | 1/1983 | Japan . | |
| 58-38905 | 8/1983 | Japan . | |
| 59-55848 | 4/1984 | Japan . | |
| 60-77339 | 5/1985 | Japan | 250/423 R |
| 61-248344 | 11/1986 | Japan | 250/423 R |
| 61-279038 | 12/1986 | Japan | 250/423 R |
| 63-101452 | 7/1988 | Japan . | |

OTHER PUBLICATIONS

"The Influence of Electrode Geometry on Liquid Metal Ion Source Performance," L. W. Swanson et al, Journal of Vacuum Science and Technology, B6, (1988), pp. 1062–1065.

"Development of Boron Liquid Metal Ion Source", Journal of Vacuum Science and Technology, A2, 1984, T. Ishitani et al, pp. 1365–1369.

"Liquid Gold Ion Source", Journal of Vacuum Science and Technology, vol. 16, 1979, A. Wagner et al, pp. 1871–1875.

"Ga, Au, Pb Field Emission Liquid Metal Ion Sources", M. Komura, pp. 13–18.

*Primary Examiner*—Jack I. Berman

*Attorney, Agent, or Firm*—Fay, Sharpe, Beall, Fagan, Minnich & McKee

[57] ABSTRACT

A liquid metal ion source (LMIS) has a reservoir for containing an ion material and an emitter disposed in relation to the reservoir such that molten ion material heated in the reservoir wets the surface of the emitter and flows to the emitter apex. Prior to charging the reservoir with the ion material, the reservoir and emitter are cleaned by a high temperature cleaning operation. For cleaning, the LMIS is placed in a vacuum chamber. A current is applied through the electric feed through terminals to heat the reservoir until it becomes red hot. Then, the emitter is heated by electron bombardment by keeping the emitter voltage at ground potential while applying a high negative voltage to the reservoir. After cleaning, the emitter and reservoir are immersed in a liquid ion material contained in the vacuum chamber and maintained in the molten state by a separate melting unit having a heater. Once the reservoir is filled, a smooth continuous flow of molten ion material is provided to the apex of the emitter for providing a continuous and stable ion emission operation. Also, shields are provided to prevent vapor deposition on the base plate from forming a short circuit between the feed through terminals and the emitter.

29 Claims, 14 Drawing Sheets

PRIOR ART

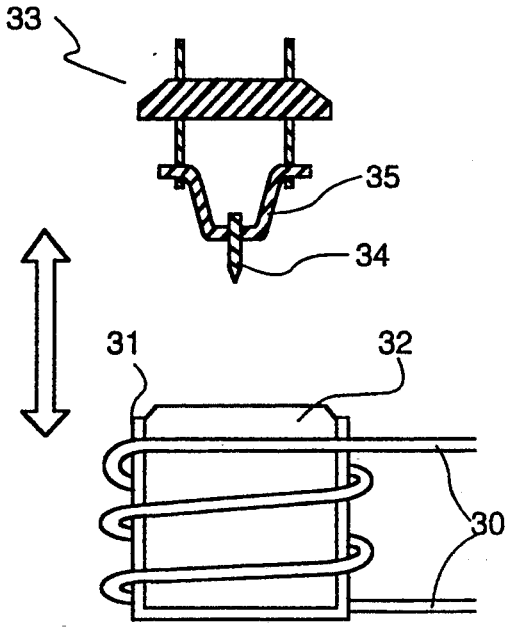
PRIOR ART
FIG. 4(a)
FIG. 4(b)
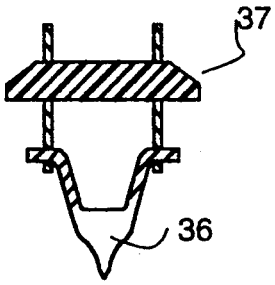
PRIOR ART

PRIOR ART

LIQUID METAL ION SOURCE WITH HIGH TEMPERATURE CLEANING APPARATUS FOR CLEANING THE EMITTER AND RESERVOIR

FIELD OF THE INVENTION

The present invention relates to a liquid metal ion source suitable for forming a focused ion beam for use in mask production and correction, modification and failure analysis of devices, maskless ion implantation, ion lithography, ion etching deposition, device transplantation and the like in semiconductor manufacturing processes; and in the cross sectioning of specimens, secondary ion mass spectrometry of very small areas and the like in the field of analysis, and in particular, it relates to a liquid metal ion source capable of providing an extremely stable ion emission for a long time.

BACKGROUND OF THE INVENTION

Ion beam technology is actively practiced in many industrial fields. Many types of ion sources have been developed for generating ions of various elements with high efficiency. Among them is an electro-hydrodynamic (EHD) ion source that uses a pure metal or alloy in a molten state as the ion material with the ions being extracted under a high electric field. This is also called a liquid metal ion source (LMIS) because it is based on the technique of extracting ions from a metal in a molten state with its ion emission being performed in a high electric field.

Liquid metal ion sources are known to have high brightness since ions are emitted from a point area of the emitter. The ion stream that is emitted can be focused into a beam (generally referred to as a focused ion beam or FIB) of a diameter less than 1 μm and projected onto a specimen as a final target, for example. This type of FIB has a high-current-density and extremely-fine beam, and so ion lithography, ion implantation, etching and the like can be implemented using this FIB in semiconductor processes without the need for conventional masks, that is, in a maskless manner. Further, such an FIB is also useful in secondary ion mass spectrometry wherein a specimen is irradiated with an ion beam to generate secondary ions that are expelled from the specimen by sputtering for analysis. Since the beam is of a very small diameter, the FIB can be used to carry out component analysis in a sub micron region on the surface of the specimen. Accordingly, FIB applications that rely on an LMIS are being made in various fields.

The structure of an LMIS and its principle of operation will be explained with reference to FIG. 2 and the following description. A typical LMIS, for example, as described in "Development of Boron Liquid Metal Ion Source" (hereinafter Prior art 1) by T. Ishitani et al., Journal of Vacuum Science and Technology A2, (1984) pp. 1365–1369, has an ion material 1 to be ionized and a heater 2 for retaining the material 1 in a liquid or molten state. An emitter 4 is disposed such that the ion material 1 is supplied from the heater 2 to the emitter for emitting ions 3 from the emitter apex. An extractor electrode 5 is provided for concentrating a high electric field around the emitter apex for extracting ions 3. The apparatus is enclosed in a vacuum chamber 6 having electric feed through terminals 7 and 7', and power supply units 8, 8' and 8''. As required, the material to be ionized is maintained in a liquid or molten condition by methods such as resistance heating by current conduction of a reservoir member for holding the ion material, electron bombardment heating in the vicinity of the emitter apex, heating with a heater wound around the reservoir that retains the ion material in a liquid or molten state, and the like. These basic constructions of an LMIS, however, are not greatly different from one another.

An LMIS having such an arrangement as above operates as follows. After evacuation of the vacuum chamber 6, the heater 2, which also serves as the reservoir, heats the ion material. Consequently, the ion material 1 and emitter 4 are heated by thermal conduction, and the liquid or molten ion material 1 is supplied to the top of the emitter 4 by wet spreading along the surface. Then, when the extractor electrode 5 is maintained with a high negative voltage, an electrical field is concentrated around the emitter apex. By applying still a higher voltage, the molten metal forms a conical protrusion, called a Taylor cone. Once a certain threshold voltage is reached, ions 3 are extracted from the emitter apex. The extracted ions pass through an ion optical system (not shown) having lenses, deflectors and the like that is disposed on the downstream side of the ion source to form an FIB.

The most widely used types of an LMIS are the hairpin type and reservoir type. FIG. 3(*a*) illustrates a hairpin type LMIS wherein a needle electrode 13 is spot-welded to the center portion of a fine wire 12 that is connected between two electric feed through terminals 11, 11' that protrude through an insulator base plate 10. An example of this type is disclosed in the Japanese Patent Publication No. 3579/1983 (hereinafter Prior art 2). This type of LMIS has a very simple construction. Wire 12 serves as a reservoir to store the ion material 14, and also serves as a heater through which a current passes between lead-in terminals 11 and 11'.

FIG. 3(*b*) shows a reservoir type LMIS. Two electric feed through terminals 16, 16' extend through an insulator base plate 15 and are secured thereto. A reservoir 18 stores an ion material 17 and is supported by wires 19, 19' which conduct a heating current to the reservoir 18. Further, an emitter 20 is fixed to the reservoir 18. An advantage of this type of LMIS is that a large amount of ion material 17 can be contained in the reservoir. An example of this type has been disclosed in Japanese Patent Publication No. 38905/1983 (hereinafter Prior Art 3).

As a modification of the reservoir type LMIS, there is a capillary needle type LMIS, as shown in FIG. 3(*c*). The bottom of the reservoir 21 is a capillary 22. The space between the emitter 23 and the capillary 22 is very small and accordingly the molten ion material 24 flows to the emitter apex 23 after passing through the space due to capillary action.

In each of the foregoing types, the LMIS is designed to be quickly disconnected from an ion beam apparatus, and thus is provided in a cartridge that includes electric feed through terminals, an emitter, a reservoir and an insulator, which can be readily replaced when the ion material is exhausted or the needle electrode is damaged and the like. Namely, this type of LMIS to which the present invention is directed is of a so-called cartridge type.

It is mentioned in the prior art that cleaning of the reservoir and emitter is important for ensuring the efficient and stable operation of an LMIS. For example, a combined prior art high temperature cleaning method for cleaning the reservoir and emitter, and subsequent method for charging the emitter and reservoir by dipping them into a molten ion material have been described in a paper titled "Liquid Gold Ion Source" by A. Wagner et al., Journal of Vacuum Science and Technology (1979) Vol. 16 pp. 1871–1875 (Prior art 4). According to this method, as shown in FIG. 4(*a*), an ion material 32 is stored in a melting pot 31 heated by a filament 30.

After the ion material 32 becomes molten, a filament type LMIS 33 is heated by current conduction and dipped into the ion material 32 such that the molten ion material 32 is allowed to adhere to an emitter 34 and a heater 35. FIG. 4(*b*) shows LMIS 37 after immersion with the ion material 36 adhered to the emitter and heater.

SUMMARY OF THE INVENTION

Ideally an LMIS should be able to sustain a stable ion emission continuously for a long time. On the surface of an emitter of an LMIS which is operating ideally, the quantity of the ion material consumed through ion emission and the quantity of the ion material supplied from the reservoir are balanced with each other. This ensures that the liquid metal flows smoothly from the reservoir to the emitter apex. When the consumption of the ion material due to ion emission exceeds the supply thereof to the ion emitting member (emitter), there occurs a decrease in the ion current under a constant extraction voltage, or there occurs an increase in the extraction voltage under a constant current control. In contrast, in the case where the supply of the liquid metal to the ion emitting member exceeds the consumption due to ion emission, the radius of curvature of the liquid metal at the emitter apex becomes larger, causing problems such as increasing the extraction voltage, dripping of the liquid metal and the like. Therefore, it is required for an ideal LMIS that a constant flow of the liquid metal be provided along the surface of the emitter. Typically an LMIS is most frequently effected by an insufficient supply of the liquid metal to the ion emitting member.

The main causes of the insufficient supply of the liquid metal are due to: (1) the structure of the LMIS, and in particular, the arrangement and structure of the emitter, reservoir and heater which leads to a retarded flow of the liquid metal (or at times even a stoppage in the flow) to the emitter apex from the reservoir as a result of the surface electrical resistance on the emitter; and (2) the inhomogeneous wetting of the emitter surface with the liquid metal that occurs when an impurity layer of oxides or the like is formed on the emitter surface. In particular, the wettability between the liquid metal and the emitter deteriorates, thereby impeding the smooth flow of the liquid metal along the surface of the emitter.

The problems of the prior art will be described in more detail in the following.

(A) Flow of the Liquid Metal From the Reservoir to the Emitter Apex.

One important disadvantage of the hairpin type LMIS is that the molten ion material does not flow continuously and smoothly from the reservoir to the emitter apex. That is, when a continuous ion emission is performed under a constant condition, the ion current decreases stepwise, thus temporarily requiring an operation for increasing the operational temperature of the LMIS in order to maintain the same emission condition.

With reference to FIGS. 5 and 6, this cause will be explained as follows. An emitter 41 is spot-welded to a heater 42 (FIG. 5). Thereby, the surface of a weld 43 is roughened, which consequently prevents an ion material 45 contained in a reservoir 44 from smoothly flowing down to the emitter apex. FIGS. 6(*a*) and 6(*b*) are enlarged views of an area A shown in FIG. 5 surrounding the spot weld joint between the heater 42 and emitter 41. No ion material is shown adhered to the emitter 41. In particular, FIG. 6(*a*) is a frontal view thereof, and FIG. 6(*b*) is a side view thereof.

As shown in FIGS. 6(*a*) and 6(*b*), a tungsten wire is provided with axially extending narrow grooves 46 along its surface that have been cut during a manufacturing step. The liquid metal (molten ion material) flows along the narrow grooves 46. A microscopic observation of an LMIS having this type of structure was performed in the region of the junction between the heater and emitter after the LMIS had reached a terminated emission condition following a continuous emitting operation. It was confirmed that the flow of ion material 45 had stopped flowing down from the reservoir 44 as a result of its flow being blocked by the spot weld 43 by which the emitter 41 and heater 42 are joined. Further, flow of the ion material 45 attached to the heater 42 was stopped by the small grooves 46 formed in the surface of the wire heater 42 since the flow could not proceed across these grooves to the opposite side thereof. Accordingly, only the ion material attached to the emitter 41 below the spot weld 43 was consumed in the ion emission, which, when exhausted, caused the ion emission to be terminated.

In operation of the LMIS set forth above, even though plenty of ion material 45 remains in the reservoir 44, once the ion material attached to the limited area of the emitter is exhausted by ion emission, the ion source must be heat treated. The heat treatment is required to enable the ion material to move across the small grooves 46 of the heater wire and the spot weld 43 to supply the emitter with the ion material. As a result, periodic heat treatment is required to ensure smooth and continuous operation of the LMIS.

In view of the problems set forth in the foregoing, the present invention is directed to developing an LMIS that can continuously supply an ion material retained in a reservoir to the emitter apex, until the material in the reservoir is exhausted, thus providing a stable ion emission for a long period of time without the need for an intermediate heat treatment.

(B) Removal of Impurities on the Surface of the Emitter.

When there exist impurities on the surfaces of the emitter and reservoir, the liquid ion material will not uniformly flow along these surfaces. An impurity layer, such as an oxide film or the like, on a metal surface causes the uniform contact with the liquid metal to be impeded, and thus adversely affects the ion emission stability.

In order to prevent such adverse effects from taking place, a high temperature cleaning of at least the emitter and reservoir is performed in an ultra high vacuum. This cleaning removes the impurities such as carbons, oxides and the like that are present on the surfaces of the emitter and reservoir. Most liquid metals flow very well along these surfaces after cleaning.

There have been reports, including one described in Prior Art 4 in which the emitter of a filament type LMIS is heated by current application as shown in FIG. 4 for cleaning, and another one in which a reservoir type LMIS having a structure in which the emitter is firmly connected to the reservoir is heated by current application for cleaning. There have been no reports, however, that have disclosed a high temperature cleaning method and its apparatus for an LMIS apparatus having a structure in which the reservoir and emitter are not in direct electrical contact with each other before being charged with the ion material.

(C) Heating the Emitter and Reservoir.

In the case where the surface of the emitter of an LMIS is covered with an oxide film, for example, and consequently a good wettability between the liquid metal and the emitter or the reservoir is not ensured, the liquid metal cannot be stably supplied to the emitter apex. This results in a termination of the ion emission. Since an LMIS is frequently made part of an ion beam apparatus, stable and continuous ion emission over a long period of time is critical, and an interruption in the ion emission is highly undesirable. Therefore, it is indispensable to perform a high temperature cleaning operation under a high vacuum condition of at least the emitter and reservoir before the ion material is charged.

In the prior art heating methods for achieving this purpose, and in particular, as they are applied to a hairpin type LMIS as shown in FIG. 3(*a*), the heating efficiency of the emitter and the reservoir is excellent. However, in the case of the reservoir type LMIS where the emitter is firmly fixed as shown in FIGS. 3(*b*) and (*c*), the heating efficiency of the emitter and reservoir is not very high because the emitter is heated only through heat conduction and radiation from the reservoir. Further, in the case where the emitter and the reservoir are isolated from each other, although the reservoir can be directly heated by current application, the emitter is heated only via radiation. With respect to a reservoir type LMIS, in particular, and with respect to an LMIS whose emitter and reservoir are electrically isolated from each other, there have been no reports on an efficient heating method for effectively heating both the emitter and reservoir.

(D) Preventing Deposition on the Insulator.

After a long operation of an LMIS or at the time of charging of the ion material, evaporated ion material 60 deposits on an insulator 61 and forms a conductive deposition film 63 as shown in FIG. 7, thus causing short circuit problems. As a result, application of a predetermined voltage becomes impossible, and the short-circuit formed between the electric feed through terminals 62 and 62' prevents application of a current for heating the reservoir 64. For example, when there occurs a short-circuit between the electric feed through terminals, a predetermined current supply required for melting the ion material cannot be ensured, causing a solidification of the ion material. This finally results in a termination of the ion emission. Accordingly, it is desirable to develop some effective measures which can prevent vapor deposition of the evaporated ion material, in particular, on the insulator between the terminals through which a heating current is supplied.

In view of the foregoing problems, the principal object of the present invention is to solve the above problems (A) and (B) while it is another object of the invention to provide a solution to the problems (B) and (C).

More specifically, a first object of the invention is to provide a liquid metal ion source with a simplified structure which provides a stable and continuous flow of a liquid metal (molten ion material) to the emitter apex for many hours, A second object of the invention is to provide a liquid metal ion source which, while achieving the above first object, operates stably for a long time.

A third object of the invention is to provide a liquid metal ion source which has a structure such that the emitter and reservoir can be heated efficiently.

A fourth object of the invention is to provide a liquid metal ion source which has a structure capable of preventing a short-circuit between the electric feed through terminals due to vapor deposition of the ion material for preventing a resultant short life of the ion source.

A fifth object of the invention is to provide a high temperature cleaning apparatus for cleaning the emitter and the reservoir in a high vacuum.

The first, second and third objects of the present invention are accomplished as set forth in the following, with reference to the description of the components of the preferred embodiments.

(i) Tubular Reservoir

As described, the hairpin type LMIS in which a wire is bent and an emitter is spot-welded to the V-shaped tip end of the bent wire is not suitable for use in a long continuous ion emission operation. A structure that will not impede the flow of a liquid ion material is preferable, for example, a structure of the reservoir type wherein the emitter is not welded to the reservoir nor to the heater. In order to provide an apparatus that retains a greater quantity of the ion material than the filament type, and at the same time continuously provides a supply of the molten ion material retained in the reservoir to the apex of the emitter, it is desirable for the ion material retainer member to be of a reservoir type. Further, taking into account that the exposed area of the reservoir should be minimized in order to minimize the area where vapor of the ion material from the reservoir is deposited, it is preferred that the reservoir be of a tubular type.

(ii) Electron Bombardment

Taking into account that the emitter and the reservoir are cleaned at a high temperature and in an extra high vacuum, and that the ion material is charged in situ, the reservoir should preferably function as an electron source for electron bombardment of the emitter.

(iii) Electrical Insulation Between the Emitter and the Electric Feed through Terminals In order to achieve axial alignment, the emitter is preferably linear. Further, in consideration of the heating efficiency requirements of the emitter, electron bombardment heating is more desirable than conduction heating of the emitter. The emitter is supported by a conductive support terminal. Under the condition that the ion material is not charged, because a voltage can be applied between the electric feed through terminals and the emitter, the emitter can be cleaned by an electron bombardment high temperature cleaning treatment prior to the charging of the ion material. Further, because the reservoir is of a tubular type, the manufacture of the reservoir is simplified, the emitter becomes an efficient electron source when heated, and the liquid ion material can be smoothly supplied to the ion emission portion at the emitter apex. Further, as shown in FIG. 8, the area of the insulator 72 to which the evaporated ion material 71 adheres is limited, thus preventing a short-circuit between the electric feed through terminals 73 and 73'.

With respect to the specific dimensions of a tubular pipe as the reservoir, when its inner diameter is less than 0.2 mm, the emitter and the reservoir can contact each other too easily, while when it is more than 2 mm, the liquid ion material tends to steadily drop. By way of example, when the outside diameter of the emitter is 0.32 mm, the inner diameter of the reservoir is 1 mm with an outside diameter of 1.4 mm, and the length thereof is 2 mm, the reservoir has a net storage capacity of approximately 1.4 $mm^3$. However, when taking into account expansion at both the upper and lower ends of the tubular pipe, molten ion material of approximately 1.8 $mm^3$ can be retained. When the ion material is gallium, this volume corresponds to approximately 11 mg, which, when subjected to a continuous emission at a total emission ion current of 1 $\mu$A, will last for about 180 days of service life when resistance heating is performed in contact with the reservoir.

In order to carry out high temperature cleaning of the emitter and the reservoir, which must be conducted prior to the charging of the ion material, the liquid metal ion source preferably has a structure in which electrical insulation can be ensured between the electric feed through terminals and the emitter. In particular, the reservoir and the emitter are applied with a voltage independently of each other before the ion material is charged so that the electrons from the heated reservoir can be accelerated to strike the emitter.

(iv) Operation With Vapor-Deposition Prevention

It is an object of the invention to prevent a short circuit between the electric feed through terminals due to vapor deposition by providing a shield between an insulator base plate through which the electric feed through terminals protrude and the reservoir to prevent vapor deposition on the base plate. On the other hand, if the base plate is made of metal, then the electric feed through terminals are sheathed by insulators to provide insulation therebetween and the shield can be made as an integral part of the electric feed through terminals.

Preferably, the reservoir is heated by passing a current through the two electric feed through terminals, which project through the insulator and are firmly fixed thereto. Upon heating, the ion material melts and a resultant liquid metal (molten ion material) is supplied to the emitter apex which is satisfactory for this type of ion source.

Suitable heating methods for heating the emitter include a current-application heating method, and an electron bombardment heating method. In the latter method, a filament is used in the electron bombardment of the emitter. More specifically, a potential difference is applied between the filament and the emitter to cause electrons from the red hot filament to bombard the emitter. According to the present invention, such a filament as in the latter case is not employed, instead, a conductive reservoir is heated by a current-application heating method to generate electrons which are directed to the emitter to bombard the same until it becomes red hot. Through such an arrangement, complicated design problems concerning an additional heating power source, related voltage lead-in terminals, and filament are avoided.

According to the objects of the invention, the preferred LMIS satisfies the following requirements. (1) The LMIS should have a long service life. (2) The flow of the liquid metal from the reservoir to the emitter apex should be smooth. (3) The LMIS should use an efficient heating method for heating the emitter and reservoir. And, (4) The LMIS should have a structure suitable for charging ion material into the reservoir and for permitting the material to adhere to the emitter. Such an LMIS preferably has a structure which comprises two electric feed through terminals that protrude through an insulator and which are firmly fixed thereto, a tubular reservoir for storing an ion material, wires for establishing a connection between the electric feed through terminals and the reservoir, and a needle emitter disposed through the reservoir whose surface is wetted with the molten ion material supplied therefrom. Preferably also, a voltage supply terminal supports the emitter, and in the state when the ion material is not yet charged, the electric feed through terminals are electrically isolated from the emitter support terminal. Although this is a preferred structure, some modifications such as forming the reservoir into a spiral shape, and adding a shield for preventing undesirable vapor deposition are also considered to be effective and may be preferred depending upon the application of the LMIS.

BRIEF DESCRIPTION OF THE DRAWINGS

FIGS. 4(*a*) and 4(*b*) show a conventional emitter and a reservoir.

DETAILED DESCRIPTION OF THE PREFERRED EMBODIMENTS

Figure 1A:
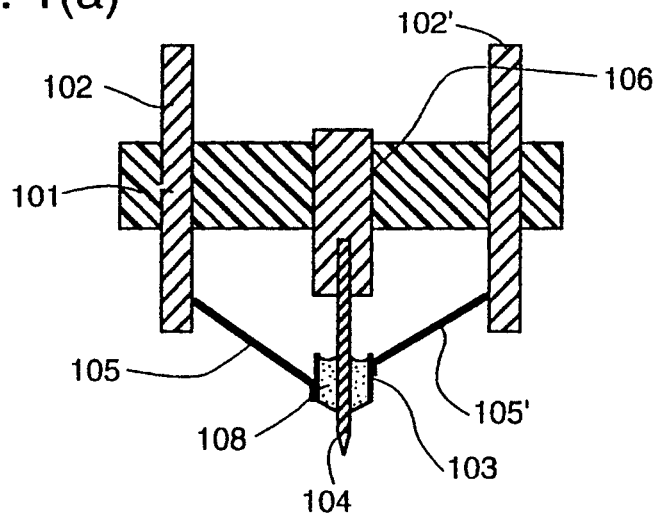
FIGS. 1(*a*) and l(*b*) show an embodiment of the present invention, wherein FIG. 1(*a*) is a partial cross-sectional view taken along line a—a in FIG. 1(*b*), and FIG. 1(*b*) is a bottom view thereof.
Figure 1B:
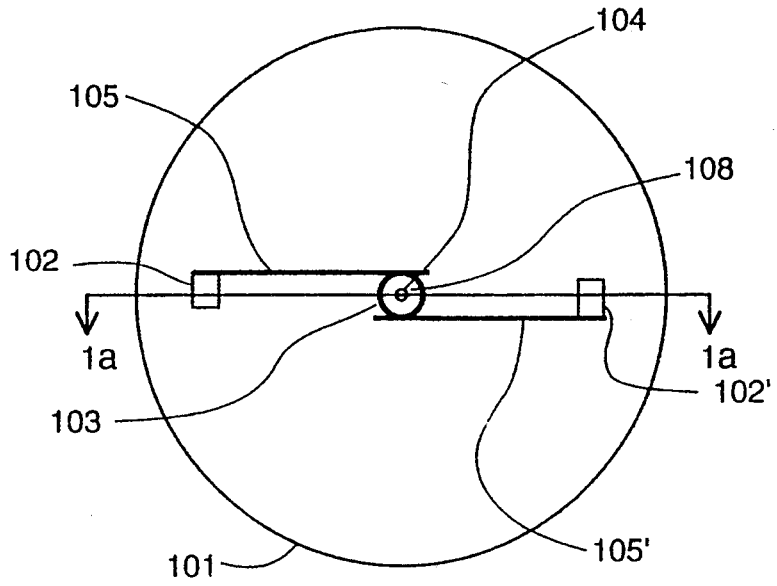

One embodiment of an LMIS of the invention is shown in FIGS. 1(*a*) and 1(*b*), wherein FIG. 1(*a*) is a partial sectional view, and FIG. 1(*b*) is a bottom view thereof. In the figures, 101 is an insulator, 102 and 102' are electric feed through terminals, 103 is a reservoir, 104 is an emitter, 105 and 105' are wires, 106 is an emitter support terminal, and 108 is the ion material.

Two electric feed through terminals 102 and 102' are fixed to the insulator 101. The reservoir 103 is preferably made of a tungsten thin-walled pipe that is fixed to the electric feed through terminals 102 and 102' through the wires 105, 105' by welding, for example. The emitter 104 is connected to the conductive emitter support terminal 106 which is disposed approximately at the center of the two electric feed through terminals, and is firmly fixed to the insulator 101 with its end slightly exposed. By way of example, the emitter 104 is preferably a tungsten bar having a diameter of 0.3 mm and a radius of curvature at the emitter apex of approximately 3 μm, and the reservoir is preferably a tungsten pipe having an outside diameter of 1.4 mm, an inner diameter of 1.0 mm and a length of 2 mm. The wires 105 and 105' are also preferably tungsten wires having a diameter of 0.3 mm. Further, each of the electric feed through terminals 102 and 102' is formed into a square rod at one end on the reservoir side relative to the insulator 101 so that the wires 105 and 105' can be readily spot welded thereto. Also, the terminals are formed as a circular rod at their other end so that they can be easily coupled to female electrodes (not shown).

Figure 9:
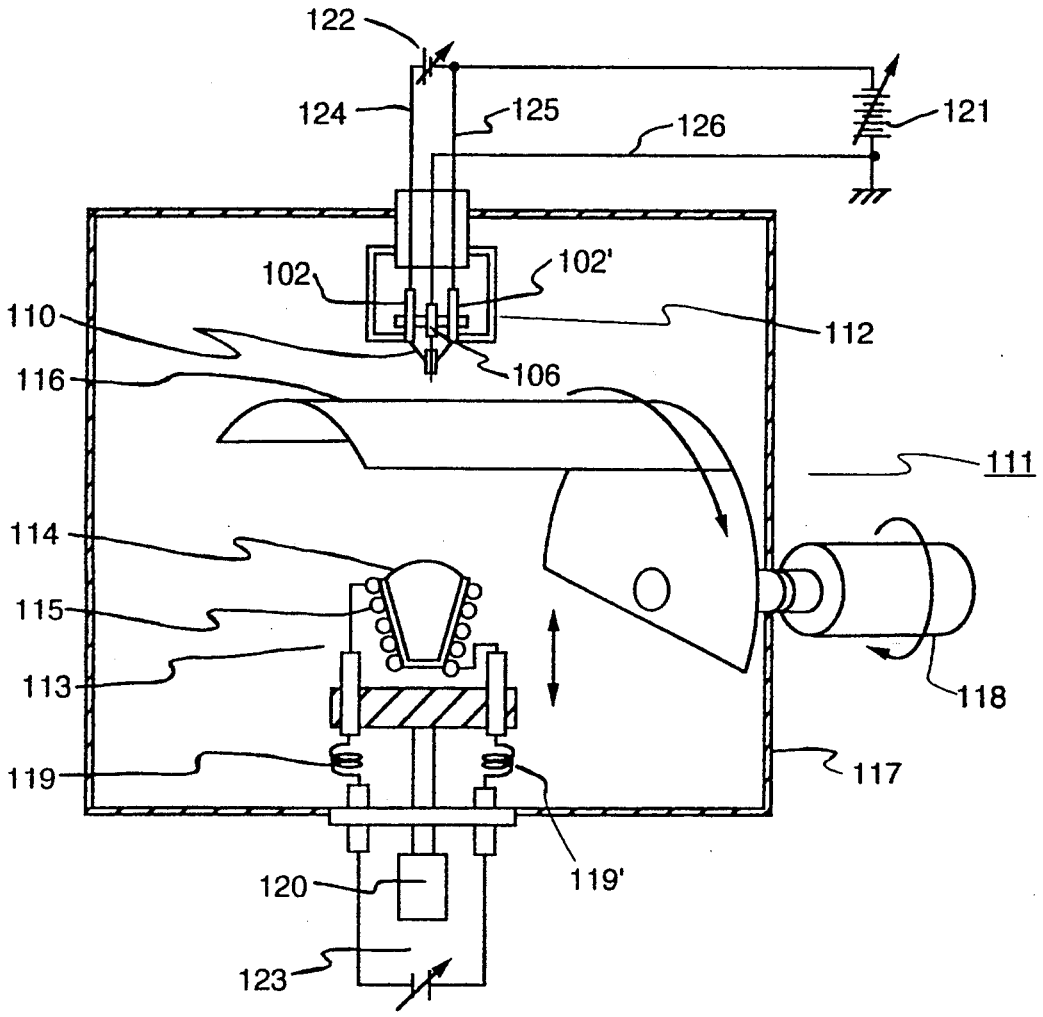
FIG. 9 is a schematic diagram illustrating an apparatus used for high temperature cleaning of the emitter and reservoir of the type of LMIS shown in FIG. 1.

A method of high temperature cleaning of the emitter and reservoir of an LMIS and of charging a molten or liquid ion material into the reservoir, and their related equipment will be described below with reference to FIG. 9. Firstly, the LMIS 110 is installed in a high temperature cleaning apparatus 111 which also serves as an ion material charging device. The LMIS high temperature cleaning apparatus 111 has an LMIS mounting part 112, an ion material melting unit 113, and a heating means 115 for heating an ion material 114, all of which are contained in a vacuum chamber 117. The cleaning apparatus 111 is provided with a shutter 116 which is operated by a rotationally-movable member 118 that prevents impurities, generated during the high-temperature cleaning of the emitter and reservoir, from being deposited on the ion material 114, and that also reduces the vapor deposition of the ion material 114 from the ion material melting unit 113 onto the LMIS 110. A related evacuation system for establishing the vacuum is not shown.

According to the invention, the ion material melting unit 113 is filled with an ion material 114 of gallium, for example, then the vacuum chamber 117 is evacuated. If necessary, a heating current is applied to unit 113 through wires 119, 119' from a power supply. When the vacuum pressure reaches approximately $1\times10^{-9}$ Torr, a current is applied from power supplies 121, 122 through wires 124, 125 and electric feed through terminals 102, 102', respectively, of the LMIS 110 to heat the reservoir until it becomes red hot (about 1800° C.). Then emitter 106 is heated by electron-bombardment by holding the emitter voltage at ground potential through wire 126, which is connected to the ground side of power supply 121, while applying a high negative voltage to the reservoir. By this process, the emitter is heated to about 1500° C. Then the heating current and the accelerating voltage are shut off, and the shutter 116 is immediately opened. The ion material melting unit 113, which contains the liquid ion material, is then lifted by a rectilinearly-movable member 120 to partially immerse the LMIS into the liquid or molten ion material 114 for coating the emitter and filling the reservoir. Incidentally, wires 119 and 119' are flexible to permit the vertical movement of the unit 113. Once the LMIS has been cleaned and charged it can be removed from the vacuum chamber and used in a preferred application, such as an apparatus requiring an FIB.

Figure 10:
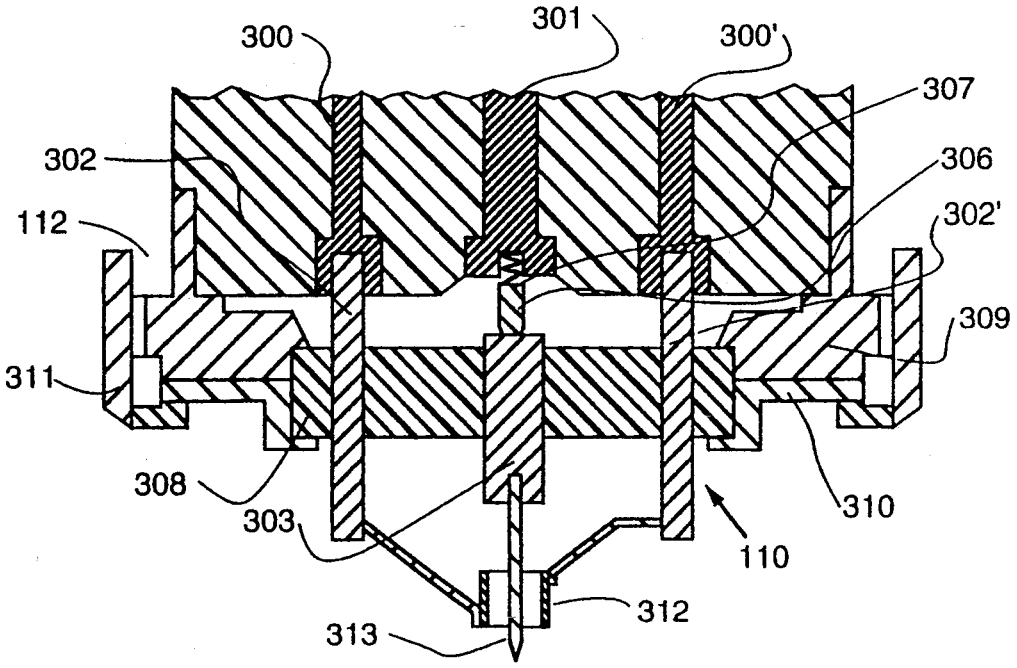
FIG. 10 shows a detailed cross-sectional view of the ion source mounting unit of FIG. 9.

The details of the LMIS mounting unit 112 will be explained with reference to FIG. 10. The LMIS mounting unit is provided with two female electrodes 300 and 300', and one male electrode 301. When the electric feed through terminals 302 and 302' of the LMIS 110, prior to charging the ion material, are fitted into the female electrode 300 and 300', the male electrode 301 comes into contact with an emitter support terminal 303. The male electrode 301 has a tip member 306 and a spring 307 which serves to prevent an excessive force from being transmitted to the LMIS 110 at the time of contact with the emitter support terminal 303. After an insulator 308 of the LMIS 110 is tightly fitted into a receptor member 309, the LMIS 110 is clamped by a presser cap 310 and a box nut 311 to fasten it to the ion source mounting member 112. In this condition, a current is passed through the electric feed through terminals of the LMIS 110 until the reservoir 312 is red hot or about 1800° C. Also a negative voltage is applied and stepped up to about 1 kV, and then electrons are emitted from the reservoir 312 toward an emitter 313 to begin electron bombardment of the emitter 313. The emitter is heated up to about 1500° C. Further although not clearly shown in FIG. 10, the presser cap 310, receptor member 309, and box nut 311 are kept at the same potential as that of the reservoir 312.

Figure 2:
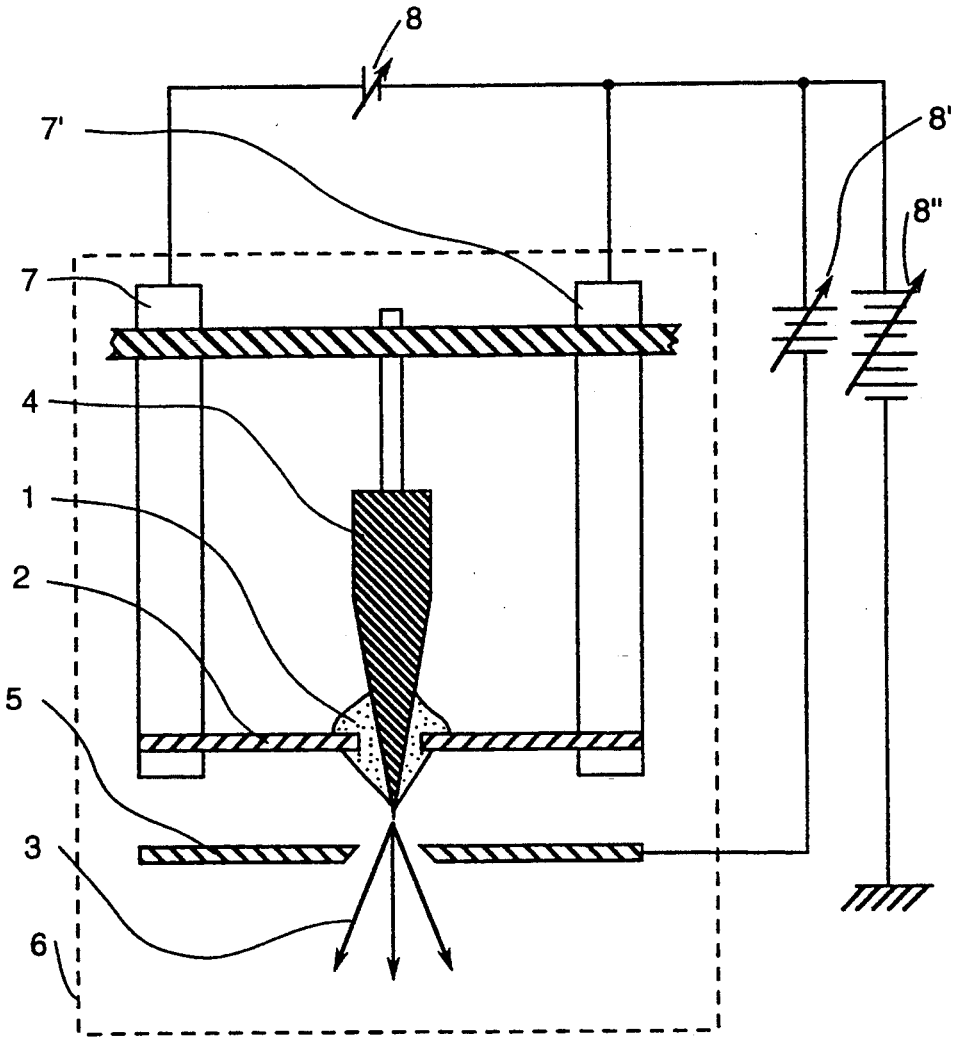
PRIOR ART FIG. 2
FIG. 2 is a schematic diagram illustrating the structure of a conventional liquid metal ion source (LMIS).
Figure 3A:
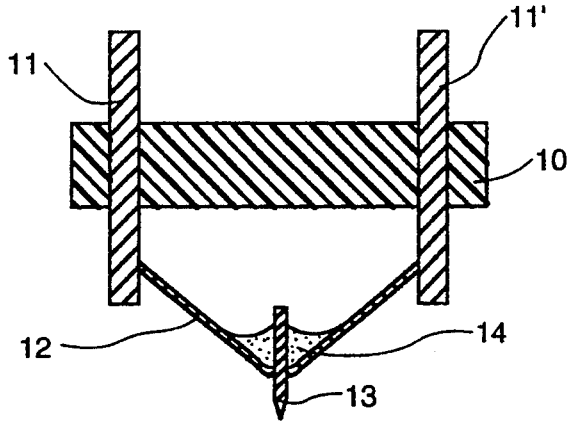
FIGS. 3(*a*)-3(*c*) show conventional structures for an LMIS, wherein FIG. 3(*a*) shows a filament type, FIG. 3(*b*) shows a reservoir type, and FIG. 3(*c*) shows a capillary needle type.
Figure 3B:
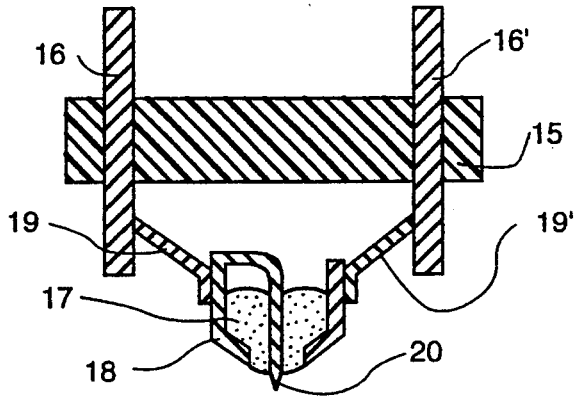
PRIOR ART FIG. 3(b)
Figure 3C:
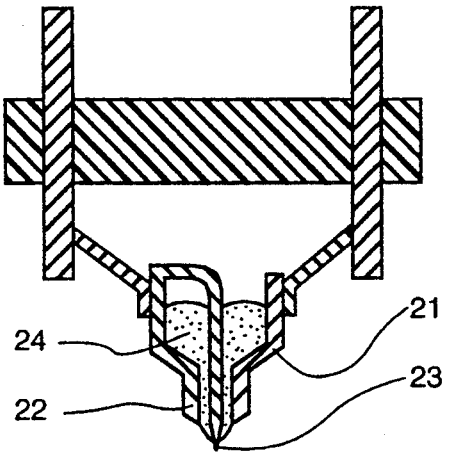
PRIOR ART FIG. 3(c)
Figure 5:
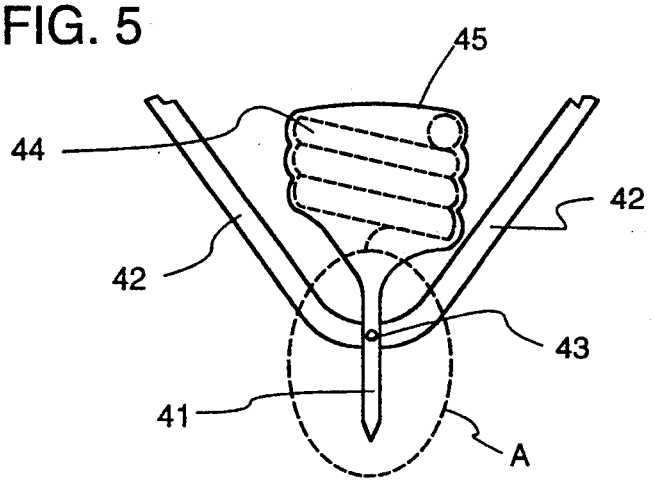
PRIOR ART FIG. 5
FIG. 5 is a drawing for explaining a cause of periodic interruption of ion emission in a conventional filament type LMIS.
Figure 6A:
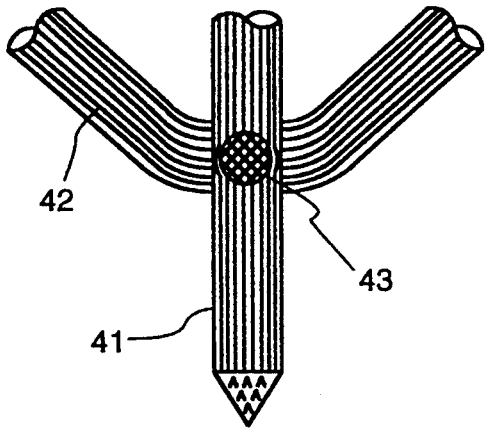
FIGS. 6(*a*) and 6(*b*) are enlarged front and side views, respectively, of the intersection of the emitter and the heater (reservoir) of FIG. 5.
Figure 6B:
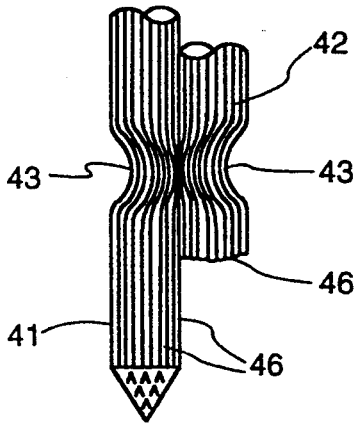
PRIOR ART FIG. 6(b)
Figure 7:
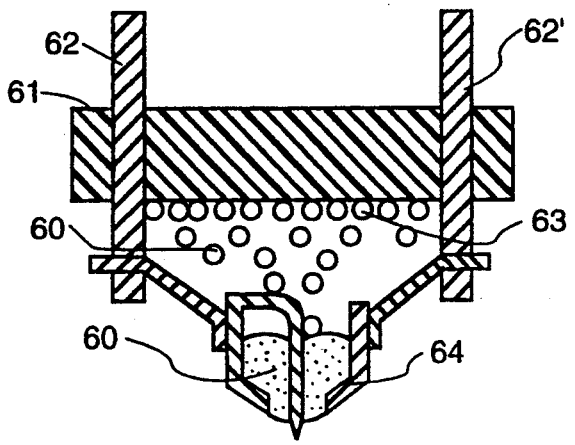
FIG. 7 illustrates the formation of a short-circuit between the electric feed through terminals of a conventional reservoir type LMIS.
Figure 8:
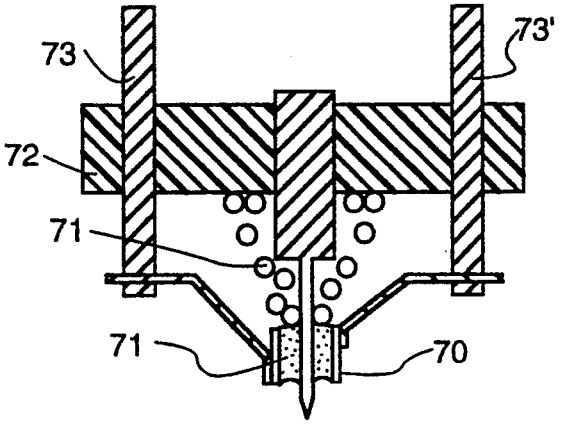
PRIOR ART FIG 8
FIG. 8 is a drawing illustrating a region where an evaporated substance is deposited when a tubular type reservoir is employed.

Next, the results of an actual ion emission using an LMIS of the present invention is evaluated in comparison with a conventional LMIS as follows. Of course, to establish an ion emission with the LMIS of the present invention, it is necessary to provide the required power supplies and extractor electrode as explained with reference to the operation of a conventional LMIS shown in FIG. 2.

As an index for indicating the smoothness of the flow of a liquid metal (liquid or molten ion material) from the reservoir to the emitter apex, a V/I index (extraction voltage value/total emission ion current value having the units of V/μA) is used. This index corresponds to a flow impedance of the liquid or molten metal on the emitter surface. When this value is constant with time, it indicates that the consumption of the liquid or molten metal on the emitter surface by ion emission is balanced with respect to the supply of the same from the reservoir. When this balance is achieved, a smooth flow of the liquid or molten metal is ensured. In contrast, when this value increases with time, it indicates that the flow impedance of the liquid or molten metal has increased for some reason, indicating that the supply from the reservoir cannot catch up with the consumption by the ion emission.

When the LMIS is used in an FIB apparatus, fluctuation in the extraction voltage causes changes in the beam diameter and irradiation position of the beam. This leads to a major problem in the use of an LMIS for an FIB. When the ion current decreases or the extraction voltage increases as discussed above, the operator of the FIB equipment performs a corrective operation based on his past experiences by increasing the operating temperature of the LMIS, or by emitting a large ion current tens to hundred times greater than the previous emission ion current so as to restore the original ion emission state. This operation of restoring the original ion current emission state is called "refresh", and it is an object of the invention to provide an LMIS that does not require a refresh operation.

Variations of V/I values over time have been measured and compared with each other for a gallium LMIS in which the emitter is spot-welded to the heater (hereinafter referred to as ion source A) and for a gallium LMIS (hereinafter referred to as ion source B) constructed according to the invention with an arrangement wherein the emitter does not contact the heater and the reservoir. Of course, the external conditions for both the ion sources, such as the charging quantity of the ion material, total emission ion current value, vacuum pressure, distance between the emitter apex and the extractor electrode, are fixed to be the same for both ion sources A and B.

Figure 11:
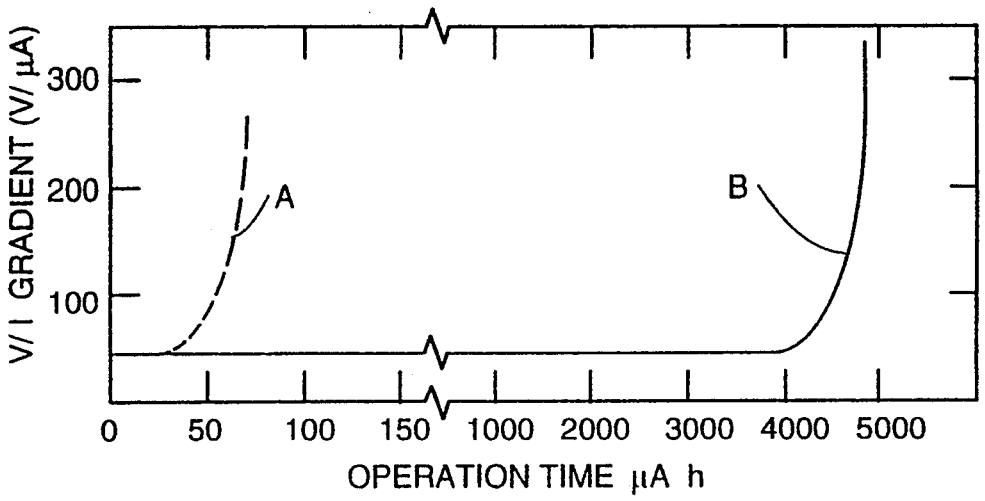
FIG. 11 shows a graph of the results of experiments conducted on a conventional filament type LMIS (ion source A) and the LMIS according to the invention (ion source B).

The results obtained under the conditions of a total emission ion current of 1 $\mu$A an operating temperature of 30° C., and an ion material charging amount of 10 mg are shown in FIG. 11. The time variation of the V/I values of the ion source A is shown by a dotted line. In its initial state, the value is constant at about 40 (V/$\mu$A), however, after about 60 hours of operation the V/I value rises significantly and consequently the ion emission is terminated. Whereas it takes about 180 days (about 4300 hours) in order to exhaust a charged quantity of 11 mg of the ion material by way of only an ion emission that is generated with a total emission ion current value of 1 $\mu$A, the ion source A, in practice, when operated, terminated its ion emission in only about 60 hours of operation. That is, the life of the ion source A without refresh is 60 $\mu$A.h. On the other hand, the result obtained with the ion source B is shown by a solid line. In the case of the ion source B, almost no change was observed in the V/I values from the beginning of the ion emission until after about 4,000 hours. After the V/I values began to increase at about 5,000 hours of operation, the ion emission terminated. The reason for the termination of ion emission in the case of the ion source B was due to the depletion of the charged ion material, which represents the end of the life of the LMIS. (In this example, a slightly greater amount of gallium adhered to the emitter than expected thus affecting the charged quantity of the ion material. In summary, the ion source B continued its ion emission until the ion material was exhausted without the requirement for refresh by an operator.

In conjunction with the results obtained with the ion source A, it has been shown that, with regard to ensuring that the liquid or molten ion material moves smoothly to the emitter apex for a long time, the hairpin type LMIS having an emitter spot-welded to a V-shaped tip end of a bent wire is not suitable. Also, it has been shown that the reservoir type LMIS is preferable since the emitter does not contact the reservoir and the heater, and as a result the flow of liquid or molten ion material is not impeded.

Figure 12:
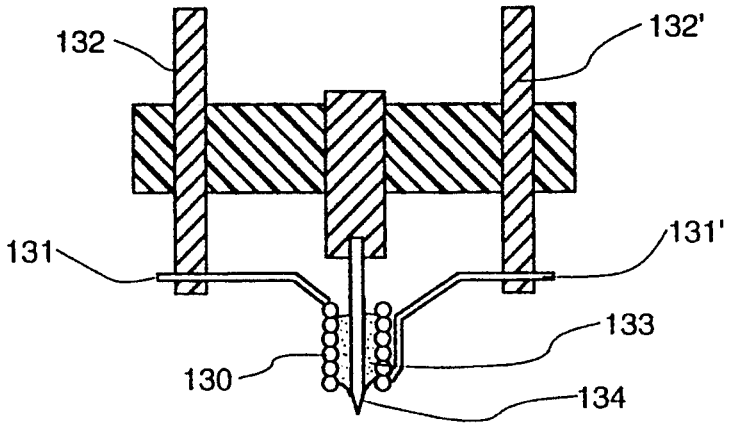
FIG. 12 is a cross-sectional view of another embodiment of an LMIS of the present invention.

Although in the preceding embodiment (Embodiment 1) of the invention, a thin-walled pipe is employed as the reservoir, the LMIS of the invention is not limited to this type of reservoir. In another embodiment, Embodiment 2 of the invention, a fine metal wire is formed into a spiral and used as a reservoir 130 as shown in FIG. 12. Because there is no need for spot-welding the reservoir and the wire, and since both ends 131, 131' of the spiral reservoir 130 are simply fixed to electric feed through terminals 132, 132', the feature of this LMIS is its improved reliability in operation without the risk of failure caused by a separation between the reservoir and the wire which can occur at the spot-weld. With respect to this LMIS, prior to charging the reservoir 130 with the ion material 133, the reservoir 130 is heated by current conduction, and the emitter 134 is subjected to a high temperature cleaning by electron bombardment.

Figure 13:
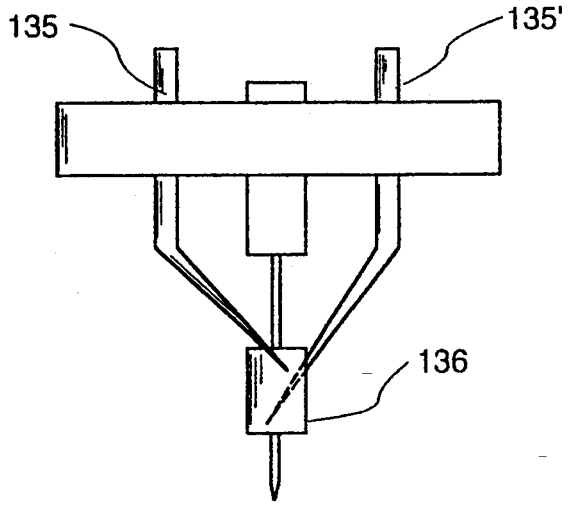
FIG. 13 is a cross-sectional view of still another embodiment of an LMIS of the present invention.

In order to supply a current to heat the reservoir of the preceding embodiments, Embodiments 1 and 2 of the invention, fine wires between the electric feed through terminals and the reservoir are used. In this embodiment of the invention, however, such fine wires are not used, instead, the tip end portions of the electric feed through terminals 135, 135' are tapered and extend toward the reservoir to allow the reservoir 136 to be directly fixed thereto as shown in FIG. 13. In FIG. 13, the reservoir 136 is spot-welded at the upper front portion and at the lower back portion thereto. In comparison with the Embodiment 1, the number of spot-welded positions is reduced, thus providing an advantage that the probability of failure in operation due to the separation at the weld joint is lowered.

Embodiment 4

In another embodiment of the invention an LMIS is provided with a shield for preventing vapor deposition onto the insulator, which will be described with reference to FIGS. 14 and 15.

Figure 14:
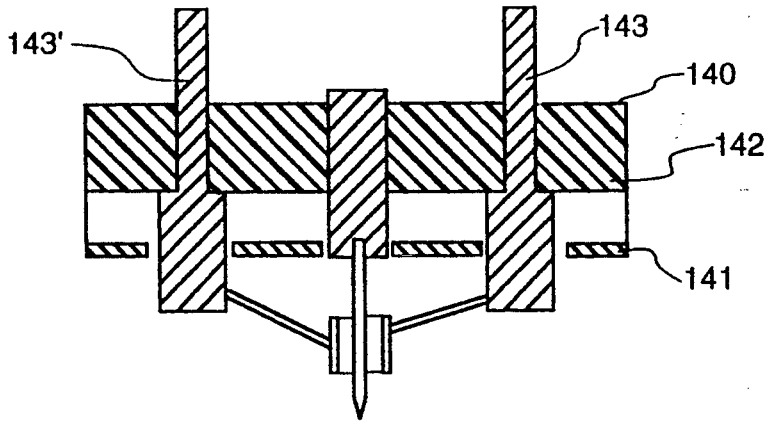
FIG. 14 is a sectional view illustrating an example of a vapor deposition shield for an LMIS constructed in accordance with an embodiment of the present invention.
Figure 15:
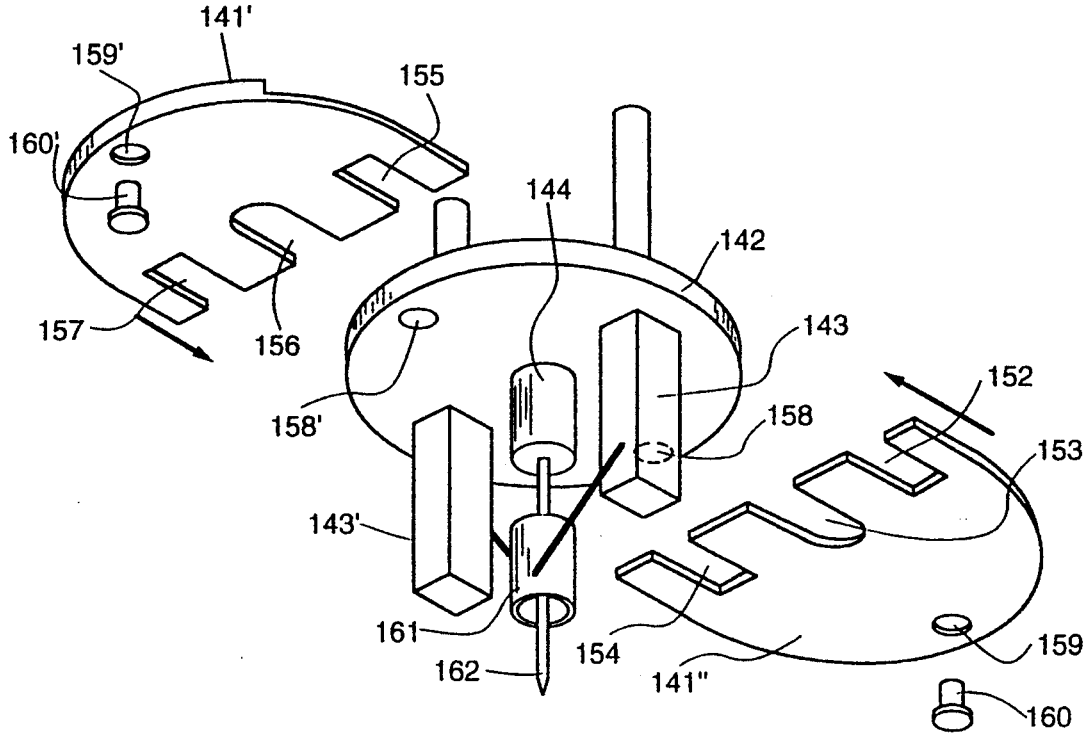
FIG. 15 is an exploded perspective view of the vapor deposition shield of FIG. 14.

FIGS. 14 and 15 illustrate insulator shields, according to the present invention, applied to an LMIS of the first embodiment (Embodiment 1). FIG. 14 is a cross-sectional view of an LMIS 140 provided with a shield 141. More specifically, as shown in FIG. 15, the LMIS comprises two metal shield portions 141'', 141' which can be inserted from a direction approximately perpendicular to a row of two electric feed through terminals 143, 143' fixed to an insulator 142 of the LMIS, and an emitter support terminal 144, and which has a length slightly exceeding that of the above row of electrodes. Metal shield 141'' has substantially the same shape as that of the shield 141' and has a height slightly different from that of the shield 141'. Further, the shields 141' and 141'' have grooves 152, 153, 154, and 155, 156, 157 respectively spaced about 1 mm apart from the electrodes. However, the shields 141', 141'' are partly in contact with the terminal 143 in order to make the potential of the shields 141' and 141'' the same as that of the reservoir 161 The shields 141', 141'' are positioned to surround the electrodes by insertion in the direction shown by the arrows, which is approximately perpendicular to the row of electrodes. Once inserted, the shields contact the sides of the insulator 142, and the shields 141'', 141' can be fastened thereto by means of screws 160, 160' passing through apertures 159, 159' and driven into screw holes 158, 158' machined in the insulator 142, respectively. When the shields 141' and 141'' are fastened to the insulator 142, and when the LMIS 140 is viewed from the apex of the emitter 162, the insulator 142 appears to be almost covered by the shields 141' and 141''. The leg portions of the two electric feed through terminals 143, 143', and an emitter support terminal 144 are spaced apart by about 3 mm. Shields 141' and 141'' prevent impurities originating from reservoir 161 and emitter 162 during high temperature cleaning from being deposited onto the insulator 142, and also prevent vapor deposition of the ion material thereupon when charging the ion material into the reservoir 161.

Figure 16:
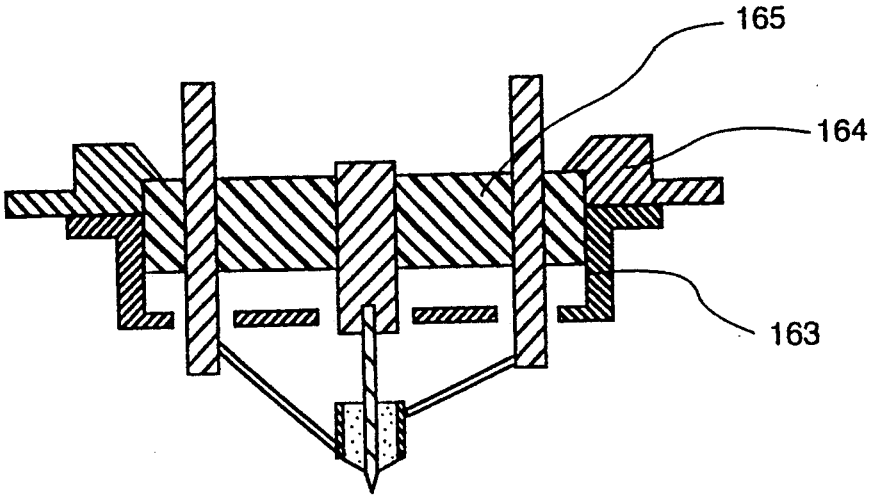
FIG. 16 is a cross-sectional view of another example of a vapor deposition shield for an LMIS of the present invention.
Figure 17:
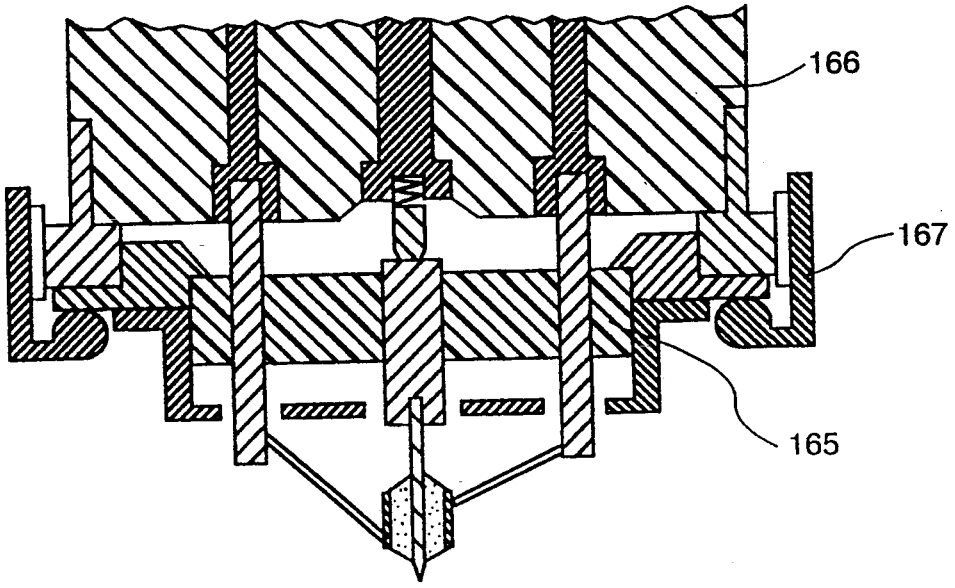
FIG. 17 shows a cross-sectional view of the LMIS of FIG. 16 secured to an ion source mounting unit.

FIG. 16 shows an LMIS 165 having a similar arrangement as above, and covered by a shield 163 and an insulator base plate 164. FIG. 17 illustrates a shielded LMIS 165 secured to an ion source mounting unit 166 by a box nut 167.

As another modification, an LMIS of the invention can be provided with an emitter support terminal which is machined into a tapered form that tapers toward the emitter and thereby prevents the insulating base plate from being subjected to vapor deposition. The above arrangement offers advantages such as a simplified structure without the need for a shield as shown in FIG. 14, thereby achieving a reduction in the number of parts, while providing the same effects as those of the foregoing embodiments of an LMIS having a shield.

Figure 18:
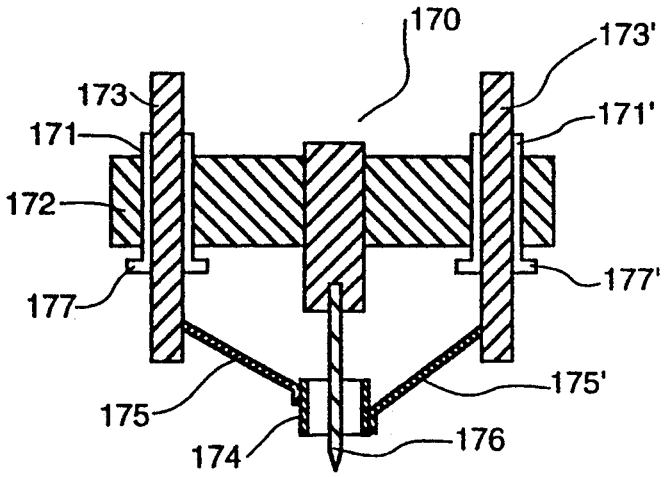
FIG. 18 is a cross-sectional view of still another example of a vapor deposition shield for an LMIS constructed according to the invention.

Still another LMIS embodying the invention and having a structure different from that of the LMIS of the first embodiment will be shown. With reference to FIG. 18, an LMIS 170 comprises two electric feed through terminals 173 and 173' provided through a metal substrate 172 and secured thereto via tubular insulators 171 and 171', a reservoir 174 for containing an ion material, wires 175 and 175' for connecting the reservoir 174 to the electric feed through terminals 173 and 173', and an emitter 176 Before the ion material is charged, the electric feed through terminals 173, 173' make no electrical contact with the emitter 176. The insulators 171, 171' have brims 177, 177' on the reservoir side. The emitter 176 is directly connected to the metal base plate 172. The brims 177, 177' are provided on the ends of the insulators to prevent vapor deposition of evaporated ion material onto the terminals at their junction with the base plate. This prevents the formation of a short-circuit between the electric feed through terminals during a long operation of the ion source, and during charging of the ion material in the reservoir. This arrangement provides a simple structure that does not require the three electrodes required for the LMIS of Embodiment 1.

Figure 19:
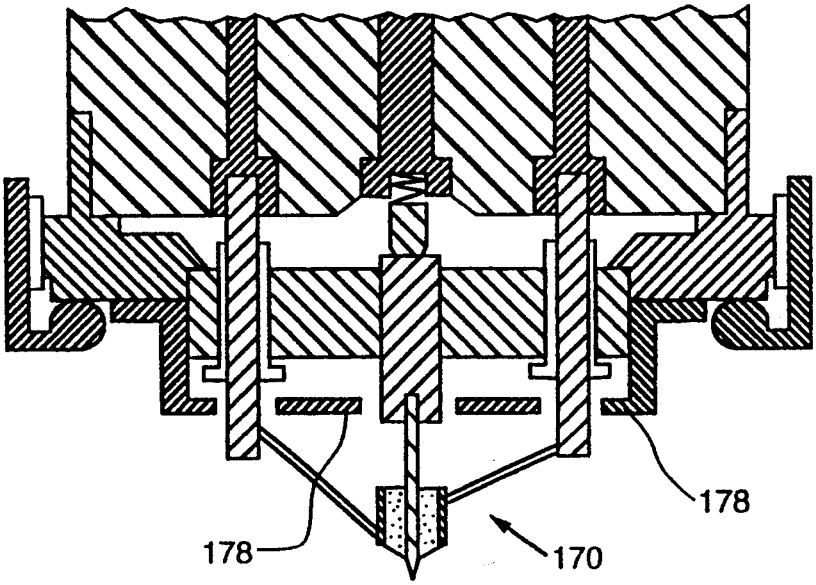
FIG. 19 is a cross-sectional view of the LMIS of FIG. 18 secured to an ion source mounting unit.

Further, as illustrated in an enlarged view of the ion source mounting unit shown in FIG. 19, a vapor deposition shield 178 analogous to the shield of Embodiment 4 of the invention can be attached to LMIS 170 to improve the effect of shielding, thereby preventing the formation of a short-circuit between the electric feed through terminals, and between the terminals and the emitter, thus ensuring a stable ion source operation for many hours.

Figure 20:
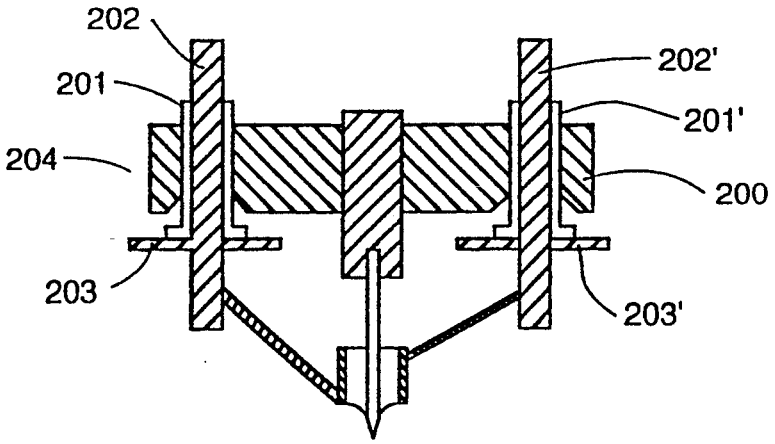
FIG. 20 is a cross-section view of still another example of a vapor deposition shield for an LMIS constructed according to the invention.

Still another embodiment, Embodiment 6, of the invention is illustrated in FIG. 20. An LMIS 204 of this embodiment comprises a metal base plate 200, and guards 203, 203' secured to or made part of electric feed through terminals 202, 202' in order to enhance the effect of preventing the possibility of conduction, due to vapor deposition, between the metal base plate 200 and the electric feed through terminals 202 and 202' which are secured to the metal base plate 200 via insulators 201 and 201'.

Figure 21:
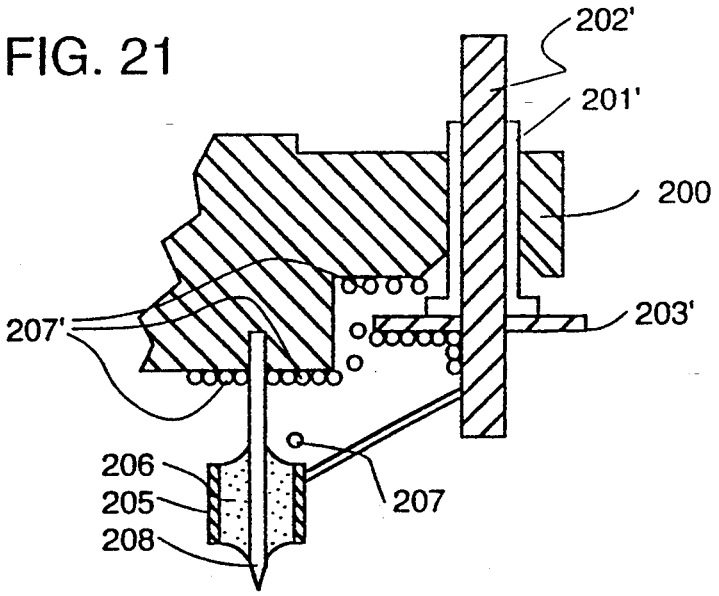
FIG. 21 is an enlarged view of a peripheral section of the LMIS of FIG. 20.

An enlarged view of the electric feed through terminal 202' and its periphery is shown in FIG. 21. Although an evaporated substance 207 from a liquid or molten ion material 206 in a reservoir 205 forms a deposit layer 207' on the metal base plate 200 and the electric feed through terminals 202, 202', it does not deposit on the insulators 201, 201', thereby avoiding the possibility of dielectric breakdown between the metal base plate and emitter 208 and the electric feed through terminals 202, 202', and the possibility of a short-circuit forming between the electric feed through terminals 202 and 202'.

A continuous, stable flow of a liquid metal (liquid or molten ion material) to the apex of an emitter over many hours can be realized in a simplified arrangement and structure according to the present invention, thereby ensuring a stable emission current/extraction voltage characteristic, and a stable operation over many hours without the need for a high temperature cleaning operation of the ion source. Further, because the emitter and reservoir can be heated to a high temperature very efficiently, a high temperature cleaning of the surfaces of the emitter and reservoir is accomplished easily, thereby allowing the emitter to be uniformly wetted with the liquid metal during ion emission, thus ensuring a stable ion emission operation. Further, short-circuits between the electrodes due to vapor deposition of the ion material, and the resultant short life of the ion source can be prevented, thus providing a liquid metal ion source having a long service life.

Still further, according to the invention, a high temperature cleaning apparatus can be provided which is capable of minimizing deposition of impurities onto the liquid metal during high temperature cleaning of the emitter and reservoir and which is capable of reducing deposition of evaporated liquid metal upon the insulators of the ion source.

We claim:

1. A liquid metal ion source, comprising:

an insulator base having opposite sides;

two electric feed through terminals secured to said base and having opposed end portions wherein one of the end portions is provided for power supply connection at one of the sides of the base and the other of said end portions protrudes from the other side of said base;

a reservoir for containing an ion material, said reservoir being supported by and electrically connected to said feed through terminals at said other end portions of the feed through terminal;

an emitter disposed adjacent to said reservoir for receiving a flow of an ion material contained in said reservoir, said emitter having an apex to which the ion material flows;

a conductive emitter support terminal fixed to said base supporting said emitter, wherein said emitter, and means connected to said one end of said feed through terminals and said emitter support terminal for supplying power to said feed through terminals at a potential lower than a potential of said emitter wherein said emitter is electrically isolated from said reservoir and said feed through terminals when power is supplied from said power supplying means through said feed through terminals to said reservoir prior to said reservoir being charged with an ion material.

2. A liquid metal ion source according to claim 1, wherein said other end portions of said electric feed through terminals are tapered and extend toward said reservoir, said through terminals being directly connected to said reservoir.

3. A liquid metal ion source as claimed in claim 1, wherein said reservoir is a tubular reservoir and said emitter extends coaxially through said tubular reservoir.

4. A liquid metal ion source as claimed in claim 1, wherein said reservoir is formed by spirally winding a metal wire having opposite ends, wherein each of said wire ends is respectively connected to one of said other end portions of said feed through terminals.

5. A liquid metal ion source as set forth in claim 3, wherein said emitter is separated from said reservoir by a space extending in a radial direction perpendicular to an axis of said emitter, said space being in a range from 0.2 mm to 2 mm.

6. A liquid metal ion source as claimed in claim 1, wherein said emitter support terminal is centrally positioned between the feed through terminals.

7. A liquid metal ion source as claimed in claim 1, wherein said base is a disc shaped insulator and said emitter support terminal and said electric feed through terminals pass through the base along a diameter of the base such that the emitter support terminal is disposed at a center portion of the disc shaped insulator plate between the electric feed through terminals.

8. A liquid metal ion source as claimed in claim 1, wherein said emitter support terminal includes quick disconnect means for disconnecting the emitter.

9. A liquid metal ion source as set forth in claim 1, wherein said electric feed through terminals and said emitter support terminal are separated by a distance extending across said base plate of at least 1 mm.

10. A liquid metal ion source as claimed in claim 1, wherein said emitter is a needle emitter that extends through said reservoir.

11. A liquid metal ion source as set forth in claim 1, further comprising a vapor deposition shield positioned between said base and said reservoir for preventing ion material from being deposited on said base.

12. A liquid metal ion source as set forth in claim 11, wherein said vapor deposition shield is detachable from the liquid metal ion source.

13. A liquid metal ion source as claimed in claim 12, wherein said vapor deposition shield includes two shield portions having facing groove portions for receiving the electric feed through terminals and emitter support terminal, respectively, said shield portions surrounding the feed through and emitter support terminals to shield the base plate from the reservoir.

14. A liquid metal ion source as set forth in claim 13, wherein said vapor deposition shield is separated from said base plate by a gap in the range of 0.5 mm to 2 mm.

15. A liquid metal ion source as claimed in claim 13, wherein the surrounding portion of each of said shield portions is spaced from a corresponding one of said electric feed through and emitter support terminals by a space of 0.5 mm to 5 mm.

16. A liquid metal ion source, comprising:

a metal base having opposite sides;

two electric feed through terminals secured to said base with insulators therebetween, said feed through terminals having opposed end portions wherein one of the end portions is provided for power supply connection at one of the sides of the base and the other of said end portions protrudes from the other side of said base;

a reservoir for containing an ion material, said reservoir being supported by and electrically connected to said feed through terminals at said other end portions of the feed through terminal;

an emitter disposed adjacent to said reservoir for receiving a flow of an ion material contained in said reservoir, said emitter having an apex to which the ion material flows;

a conductive emitter support terminal fixed to said base and connected to and supporting said emitter, and means connected to said one end of said feed through terminals and said emitter support terminal for supplying power to said feed through terminals at a potential lower than a potential of said emitter wherein said emitter is electrically isolated from said reservoir and said feed through terminals when power is supplied through said feed through terminals to said reservoir prior to said reservoir being charged with an ion material.

17. A liquid metal ion source according to claim 16, wherein said other end portions of said electric feed through terminals are tapered and extend toward said reservoir with said through terminals being directly connected to said reservoir.

18. A liquid metal ion source as claimed in claim 16, wherein said reservoir is a tubular reservoir and said emitter extends coaxially through said tubular reservoir.

19. A liquid metal ion source as set forth in claim 18, wherein said emitter is separated from said reservoir by a space extending in a radial direction perpendicular to an axis of said emitter, said space being in a range from 0.2 mm to 2 mm 20. A liquid metal ion source as claimed in claim 16, wherein said emitter support terminal is centrally positioned between the feed through terminals.

21. A liquid metal ion source as claimed in claim 16, wherein said emitter support terminal includes quick disconnect means for disconnecting the emitter.

22. A liquid metal ion source as set forth in claim 16, wherein said electric feed through terminals and said emitter support terminal are separated by a distance extending across said base plate of at least 1 mm.

23. A liquid metal ion source as claimed in claim 18, wherein said emitter is a needle emitter that extends through said reservoir.

24. A liquid metal ion source as set forth in claim 16, further comprising a vapor deposition shield positioned between said base and said reservoir for preventing ion material from being deposited on said base.

25. A liquid metal ion source as set forth in claim 24, wherein said vapor deposition shield is detachable from the liquid metal ion source.

26. A liquid metal ion source as claimed in claim 16, further comprising said base being a metal base plate; said insulators being tubular insulators; and each of said electric feed through terminals being secured to metal base plate through said tubular insulators.

27. A liquid metal ion source as set forth in claim 26, wherein said tubular insulators have a brim at a terminal end portion facing the reservoir.

28. A liquid metal ion source as claimed in claim 27, wherein said electric feed through terminals have an integrally formed vapor deposition shield extending outwardly therefrom for shielding the electric feed through terminal insulators.

29. An apparatus for cleaning an emitter and a reservoir of a liquid metal ion source (LMIS) prior to said reservoir being charged with an ion source, comprising:

a vacuum chamber;

means supporting an LMIS within said vacuum chamber, said LMIS having a base, two electric feed through terminals having opposite end portions with one end portion of each connected to a first electric power supply, wherein said reservoir is electrically connected to and supported by said feed through terminals at the other end portion of the terminals for heating the reservoir by applying a current from said first power supply through the feed through terminals;

and a second electric power supply connected to said emitter support terminal for applying a positive potential relative to the reservoir for cleaning said emitter by electron bombardment, wherein said first electric power supply heats said reservoir to a temperature sufficient to provide electrons and said second electric power supply applies a ground potential to the emitter support terminal with respect to said reservoir for generating said electron bombardment.

* * * * *